United States Patent [19]

Chitose

[11] Patent Number: 4,540,967

[45] Date of Patent: Sep. 10, 1985

[54] MOLDED TRANSFORMER WITH GROUNDED ELECTRICALLY CONDUCTIVE LAYER

[75] Inventor: Takashi Chitose, Itami, Japan

[73] Assignee: Mitsubishi Denki Kabushiki Kaisha, Tokyo, Japan

[21] Appl. No.: 393,087

[22] Filed: Jun. 28, 1982

[51] Int. Cl.[3] ..... H01F 15/04

[52] U.S. Cl. ..... 336/84 C; 336/77; 336/84 R; 336/96

[58] Field of Search ..... 336/77, 84 C, 84 R, 336/96

[56] References Cited

FOREIGN PATENT DOCUMENTS 13927 2/1979 Japan ..... 336/84 C

OTHER PUBLICATIONS

Pamphlet of Transformatoren Union Aktiengesellshaft entitled "AEG Cast-Resin Dry-Type Transformers GEAFOL authored by Edwin Hader and Richard Pfeiffer, pp. 3-6.

*Primary Examiner*—A. T. Grimley
*Assistant Examiner*—S. Steward
*Attorney, Agent, or Firm*—Wenderoth, Lind & Ponack

[57] ABSTRACT

This invention relates to a molded transformer whose windings are cast-insulated with a cast resin, and consists in disposing an electrically conductive layer within the resin insulation of the winding and grounding the conductive layer, thereby to enhance a withstand voltage with the dimensions of the air gap between the windings reduced and with a winding supporting spacer omitted.

1 Claim, 2 Drawing Figures

MOLDED TRANSFORMER WITH GROUNDED ELECTRICALLY CONDUCTIVE LAYER

BACKGROUND OF THE INVENTION

This invention relates to a molded transformer whose windings are cast-insulated with a cast resin.

The insulating structure of the windings of a prior-art molded transformer has been shown in FIG. 1. This figure is a partial vertical sectional view showing only the one-side half of the windings disposed on a core. Referring to the figure, numeral 1 designates the core, numeral 2 a high-voltage coil which is wound round the core 1, numeral 3 a resin insulation layer which cast-insulates the high-voltage coil 2, numeral 4 a low-voltage coil which is wound round the core 1 inside the high-voltage coil 2, numeral 5 a cushion material, numeral 6 a coil supporting spacer which is disposed in order to secure an air gap 7 necessary for insulation between the high-voltage coil 2 and the low-voltage coil 4, and numeral 8 a winding supporting member which holds the coils 2 and 4 through the coil supporting spacer 6 and whose end remote from the spacer 6 is fixed to the core 1.

The insulating structure of the windings of the prior-art molded transformer is based on insulation with the resin insulation layer 3 and the air gap 7 or the coil supporting spacer 6 combined. More specifically, the insulation between the high-volatage coil 2 and the low-voltage coil 4 is the combined insulation utilizing the part of the resin insulation layer 3 inside the high-voltage coil, the air gap 7 between the high-and low-voltage coils and the part of a resin layer (not shown) outside the low-voltage coil. The insulation between the high-voltage coil 2 and the winding supporting member 8 is also the combined insulaton utilizing the resin insulation layer 3 of the high-voltage coil and the coil supporting spacer 6.

In this case, the dielectric breakdown is determined by the electric field intensity of the air gap 7 in the structure of the combined insulation of the resin insulation layer 3 and the air gap 7, and the high breakdown voltage of the resin insulation layer 3 having an excellent dielectric strength is not fully exploited. Accordingly, the air gap between the high-and low-voltage coils must be formed larger than dimensions required for cooling. In addition, the coil supporting spacer needs to be arranged. These lead to the disadvantage that the dimensions of the molded transformer and the whole weight thereof increase.

SUMMARY OF THE INVENTION

This invention has been made in order to eliminate the disadvantage of the prior-art molded transformer, and has for its object to achieve an enhanced breakdown voltage with the dimensions of the air gap between the windings reduced and with the coil supporting spacer omitted, by disposing an electrically conductive layer within the resin insulation of the winding and grounding the conductive layer.

BRIEF DESCRIPTION OF THE DRAWINGS

In the drawings, the same symbols indicate the same or corresponding parts.

DETAILED DESCRIPTION OF THE PREFERRED EMBODIMENT

Figure 1:
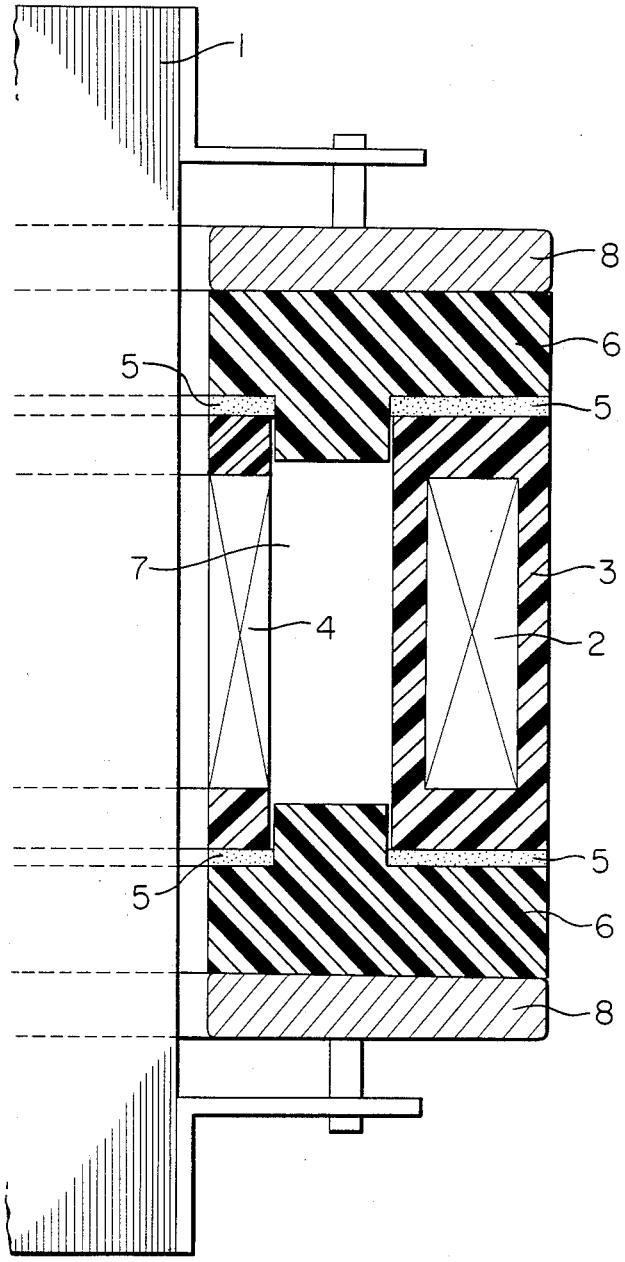
FIG. 1 PRIOR ART
FIG. 1 is a partial vertical sectional view showing the winding insulating structure of a prior-art molded transfromer.
Figure 2:
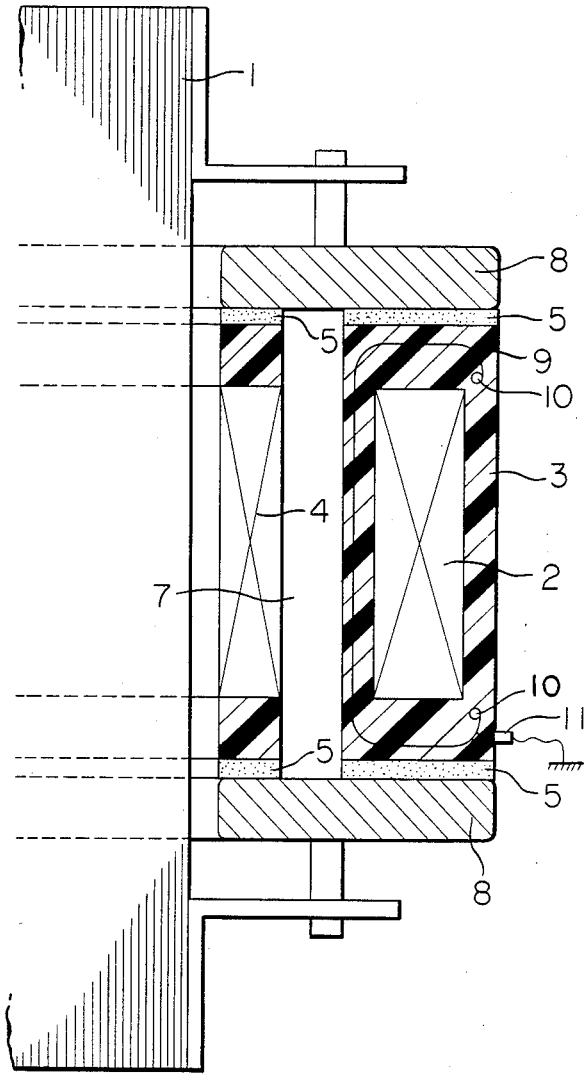
FIG. 2 is a partial vertical sectional view of the windings of a molded transformer showing an embodiment of this invention.

FIG. 2 is a vertical sectional view of the windings of a molded transformer illustrative of an embodiment of this invention. In the figure, numerals 1–5 and 7–8 indicate the same parts as in the foregoing prior art, and they will not be explained. Referring to the figure, numeral 9 indicates an electrically conductive layer which is disposed in the insulating layer 3 of the high-voltage coil 2 and continuously in a manner to surround the core 1. Numeral 10 designates a ring which is disposed at each end of the conductive layer 9 and which serves to relax an electric field and also to prevent the insulating layer 3 from cracking. Numeral 11 denotes ground terminal which is electrically connected to the conductive layer 9.

As is apparent from FIG. 2, the conductive layer 9 is buried in the insulating layer 3 is constructed of a tubular member which is open at both the upper and lower ends thereof. The vertically extending part of the tubular member opposes to the inner peripheral surface of the high-voltage coil 2. Both the end parts of the tubular member are bent outward, and are so arranged as to oppose both the upper and lower end faces of the high-voltage coil.

With such insulating structure, when the earth terminal 11 is grounded, the electric field of the high-voltage coil 2 acts only on that portion of the resin insulation layer 3 which exists between the high-voltage coil 2 and the conductive layer 9.

The conductive layer 9 can be molded simultaneously with the high-voltage coil 2 by the use of a metal foil, wire gauze or the like. Accordingly, the distance between the high-voltage coil 2 and the conductive layer 9 is determined by only the dielectric strength of the resin layer 3.

On the other hand, the air gap between the high-and low-voltage coils is subjected to only the electric field of the low-voltage coil owing to the conductive layer 9 of the high-voltage coil. Therefore, a conductive layer is unnecessary for the low-voltage coil, and the dimensions of the air gap 7 can be reduced to the minimum dimensions required for cooling. Moreover, since the coil supporting members 8 and the conductive layer 9 are equipotential (at the ground potential), any space for insulation becomes quite unnecessary, and the members 8 are allowed to adjoin the resin insulation layer 3 through only the cushion material members 5. Electric field crowding is liable to occur at the end parts of the conductive layer 9, and cracks are liable to appear in the resin insulation layer. Therefore, the rings 10 formed of round metal bars or the like are disposed to prevent them.

As set forth above, this invention adopts the insulating construction in which the electric field of a high-voltage coil acts on only a resin insulation layer. Therefore, it can render a molded transformer small in size and light in weight.

What is claimed is:

1. A molded transformer comprising:

a core;

an inner low-voltage coil and an outer high-voltage coil wound around said core;

winding support members fixing said inner low-voltage coil and said outer high-voltage coil to said core;

an insulating layer formed of cast resin enclosing said outer high-voltage coil; and a tubular, electrically conductive layer buried in said insulating layer;

said outer high-voltage coil having an upper end face and a lower end face at respective opposite ends of said outer high-voltage coil, and an inner periphery between said upper and lower end faces facing said inner low-voltage coil;

upper and lower end parts of said tubular conductive layer being bent outward so as to oppose said upper and lower end faces of said outer high-voltage coil, respectively;

a vertically extending body part of said tubular conductive layer being opposed to said inner periphery of said outer high-voltage coil;

said conductive layer being grounded;

said transformer further comprising means, including upper and lower conductive rings respectively connected to the outermost ends of said upper and lower end parts, for limiting electric fields crowding, thereby to prevent cracks in said insulating layer.

* * * * *